US010144023B2

(12) United States Patent
Apodaca et al.

(10) Patent No.: US 10,144,023 B2
(45) Date of Patent: Dec. 4, 2018

(54) TILT ACTION PUMP

(71) Applicant: HCT GROUP HOLDINGS LIMITED, Central (CN)

(72) Inventors: Adrian C. Apodaca, Daly City, CA (US); Denis Pierre Maurin, Los Angeles, CA (US); Jeremy Wilson, Los Angeles, CA (US); Xiaojun Huang, Culver City, CA (US); Armando Villarreal, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 15/655,154

(22) Filed: Jul. 20, 2017

(65) Prior Publication Data

US 2018/0021795 A1 Jan. 25, 2018

Related U.S. Application Data

(60) Provisional application No. 62/365,846, filed on Jul. 22, 2016, provisional application No. 62/467,544, filed on Mar. 6, 2017.

(51) Int. Cl.
*B05B 11/00* (2006.01)
*A45D 34/04* (2006.01)

(52) U.S. Cl.
CPC ..... *B05B 11/3014* (2013.01); *A45D 34/04* (2013.01); *B05B 11/0091* (2013.01); *B05B 11/3074* (2013.01); *A45D 2200/056* (2013.01)

(58) Field of Classification Search
CPC ..... B05B 11/3009; B05B 11/3012; B05B 11/3014; B05B 11/3029; B05B 11/3033;
(Continued)

(56) References Cited

U.S. PATENT DOCUMENTS 1,937,344 A * 11/1933 Hollingsworth .... B05B 11/3009 222/385
2,816,308 A 12/1957 Schultz
(Continued)

FOREIGN PATENT DOCUMENTS

CN 2606543 Y 3/2004
CN 2717278 Y 8/2005
(Continued)

OTHER PUBLICATIONS

International Search Report and Written Opinion dated Dec. 6, 2017 for International Application No. PCT/US2017/043050.

*Primary Examiner* — Paul R Durand
*Assistant Examiner* — Randall Gruby
(74) *Attorney, Agent, or Firm* — Seager, Tufte & Wickhem LLP

(57) ABSTRACT

A device for dispensing a cosmetic product may include a container configured to hold a volume of cosmetic product, the container having a closed lower end and an open upper end, a pump assembly disposed at least partially within the open upper end of the container, and a tip connected to the pump assembly, the tip having an outlet for dispensing the cosmetic product. The pump assembly and tip may be configured such that manually tilting the tip actuates the pump assembly to deliver a portion of the volume of cosmetic product to the outlet.

2 Claims, 10 Drawing Sheets

(58) Field of Classification Search
CPC ..... B05B 11/3035; B05B 11/3056; B05B 11/3057; B05B 11/3074; B65D 83/206; A45D 2200/055–2200/057
See application file for complete search history.

(56) References Cited

U.S. PATENT DOCUMENTS 2,866,993 A 1/1959 Edelstone
3,644,707 A 2/1972 Costello
3,710,985 A 1/1973 Baum
3,726,442 A * 4/1973 Davidson ..... B05B 11/0016 220/231
D235,418 S 6/1975 Petterson
4,029,422 A 6/1977 Pillsbury
4,147,284 A 4/1979 Mizzi et al.
4,454,966 A 6/1984 Hicks
4,456,155 A 6/1984 Miyata et al.
4,470,715 A 9/1984 Reuchlin et al.
4,592,745 A 6/1986 Rex et al.
4,630,955 A 12/1986 Ladd, Jr. et al.
4,671,431 A 6/1987 Obrist
4,708,267 A 11/1987 Sieverding et al.
4,874,117 A 10/1989 Kay et al.
4,877,157 A 10/1989 Saulle
4,880,326 A 11/1989 Spivey et al.
4,906,120 A 3/1990 Sekiguchi et al.
4,983,059 A 1/1991 Holloway
D317,253 S 6/1991 Seager
5,025,960 A 6/1991 Seager
5,492,252 A * 2/1996 Gueret ..... B05B 11/0016 222/207
5,567,073 A 10/1996 Laforcade et al.
5,738,067 A 4/1998 Landwehr et al.
5,839,626 A 11/1998 Gross et al.
5,894,960 A * 4/1999 Rodden, Jr. ..... B05B 11/303 222/207
5,951,185 A 9/1999 Kingsford et al.
5,975,375 A * 11/1999 Renault ..... B05B 11/3056 222/321.8
6,027,272 A 2/2000 Spencer et al.
6,068,421 A 5/2000 Pierpoint
6,102,602 A 8/2000 Kageyama et al.
6,142,692 A 11/2000 Garcia
6,309,124 B1 10/2001 Gueret
6,332,561 B1 12/2001 Garcia et al.
6,527,144 B2 * 3/2003 Ritsche ..... B05B 11/0037 222/153.13
6,758,374 B2 7/2004 Albisetti
6,923,589 B2 8/2005 Blackwell
6,991,135 B2 * 1/2006 von Schuckmann ..... B65D 83/0033 222/209
7,040,830 B2 5/2006 Kliegman et al.
D533,074 S 12/2006 Mongeon
7,201,527 B2 4/2007 Thorpe et al.
7,419,323 B1 9/2008 Zhang
7,476,048 B2 1/2009 Prague
7,556,179 B2 * 7/2009 Yang ..... B05B 11/0056 222/1
7,878,727 B2 2/2011 Koptis
7,959,369 B2 6/2011 Gueret
8,074,665 B2 12/2011 Pires et al.
8,161,983 B1 4/2012 Lee
8,365,962 B2 * 2/2013 Canfield ..... B05B 11/0016 222/153.13
8,444,026 B2 * 5/2013 Adams ..... B65D 83/205 222/153.11
8,499,970 B2 8/2013 Yoo
8,678,693 B2 3/2014 Sturgis et al.
8,714,857 B1 5/2014 Liu
8,839,803 B2 9/2014 Holloway
9,016,968 B2 4/2015 Thorpe
9,578,949 B2 * 2/2017 Villarreal ..... A45D 34/04
2003/0071085 A1 * 4/2003 Lasserre ..... B65D 83/30 222/521
2003/0168476 A1 * 9/2003 Sanchez ..... B65D 83/206 222/321.7
2003/0231924 A1 12/2003 Libman et al.
2004/0120753 A1 6/2004 Gieux
2004/0222124 A1 11/2004 Byun
2005/0098584 A1 * 5/2005 Do Rosario ..... B05B 11/3057 222/321.7
2006/0086759 A1 * 4/2006 Herzog ..... G01F 11/028 222/321.9
2006/0113327 A1 * 6/2006 Walters ..... B05B 11/3014 222/153.11
2006/0207627 A1 9/2006 Thorpe et al.
2006/0216104 A1 9/2006 Bouix et al.
2007/0014624 A1 1/2007 Fogelson et al.
2007/0075097 A1 * 4/2007 Behar ..... B65D 83/205 222/256
2007/0186951 A1 8/2007 Gueret
2007/0205233 A1 9/2007 Petit et al.
2007/0206986 A1 9/2007 Gueret
2008/0277427 A1 11/2008 Rossignol
2008/0314934 A1 * 12/2008 Decottignies ..... B05B 11/007 222/321.3
2009/0050650 A1 * 2/2009 Walters ..... B65D 83/205 222/153.11
2009/0097899 A1 4/2009 Carroll
2009/0188947 A1 * 7/2009 Dodd ..... B05B 1/3026 222/321.8
2009/0261127 A1 10/2009 Pan
2010/0215422 A1 8/2010 Carroll et al.
2010/0224652 A1 9/2010 Lim
2012/0031925 A1 2/2012 Greenberg
2012/0267390 A1 10/2012 Jeong et al.
2012/0267398 A1 10/2012 Lim
2013/0017010 A1 1/2013 Liu
2013/0048658 A1 2/2013 Sawata
2013/0181014 A1 * 7/2013 Decottignies ..... A45D 34/04 222/526
2013/0343798 A1 12/2013 Delage et al.
2014/0061243 A1 3/2014 Goettke
2014/0234010 A1 8/2014 Thorpe et al.
2014/0270897 A1 9/2014 Laurusonis
2015/0014368 A1 * 1/2015 Greiner-Perth ..... A61M 15/009 222/402.13
2016/0007718 A1 1/2016 Villarreal et al.
2016/0192760 A1 * 7/2016 Nishiura ..... A45D 19/02 239/337
2017/0341848 A1 * 11/2017 Py ..... A45D 34/04

FOREIGN PATENT DOCUMENTS

CN 200941885 Y 9/2007
EP 181184 A2 5/1986
FR 925899 A 9/1947
FR 2989290 B1 5/2014
GB 2404370 B 11/2005
JP 05072756 U 10/1993
JP 08238884 A 9/1996
JP 2000254575 A 9/2000
JP 2000279870 A 10/2000
JP 2003135140 A 5/2003
JP 2004154459 A 6/2004
JP 2004307071 A 11/2004
JP 3628037 B2 3/2005
KR 19970000120 A 1/1997
KR 19980056332 A 9/1998
KR 20020039098 A 5/2002
KR 200388116 Y1 6/2005
KR 200433606 Y1 12/2006
KR 1020090087074 A 8/2009
KR 100935907 B1 1/2010
KR 2020140000428 U 1/2014
KR 200471796 Y1 3/2014
WO 2012074162 A1 6/2012

(56) References Cited

FOREIGN PATENT DOCUMENTS

| | | | |
|---|---|---|---|
| WO | 2014130497 | A1 | 8/2014 |
| WO | 2015147526 | A1 | 10/2015 |

* cited by examiner

TILT ACTION PUMP

CROSS REFERENCE TO RELATED APPLICATIONS

The present application claims the benefit of and priority to U.S. Provisional Patent Application Ser. No. 62/365,846, filed on Jul. 22, 2016, titled TILT ACTION PUMP, and to U.S. Provisional Patent Application Ser. No. 62/467,544, filed on Mar. 6, 2017, titled FORWARD PUMP PEN, the disclosures of which are incorporated herein by reference.

TECHNICAL FIELD

The present disclosure relates generally to a cosmetic applicator with a pump actuated by tilting to dispense cosmetic product.

SUMMARY

According to some embodiments of the present disclosure, a device for dispensing a cosmetic product comprises a container configured to hold a volume of cosmetic product, the container having a closed lower end and an open upper end, a pump assembly disposed at least partially within the open upper end of the container, and a tip connected to the pump assembly, the tip having an outlet for dispensing the cosmetic product, wherein the pump assembly and tip are configured such that manually tilting the tip actuates the pump assembly to deliver a portion of the volume of cosmetic product to the outlet.

Alternatively or additionally, in another example, the device further comprising a driver connected to the pump assembly and an actuator connected to the driver, wherein the tip and the actuator are pivotably connected at a hinge.

Alternatively or additionally, in another example, the actuator has an angled upper face and the tip has a horizontal lower surface, wherein the actuator upper face angles away from the tip lower surface on a side of the device opposite the hinge, defining a space between the tip horizontal lower surface and the actuator upper face.

Alternatively or additionally, in another example, the driver includes a rod extending through the space and into contact with the tip horizontal lower surface.

Alternatively or additionally, in another example, movement of the horizontal lower surface of the tip towards the actuator upper face moves the rod, thereby actuating the pump assembly.

Alternatively or additionally, in another example, the device further comprising a collar connected to the container, wherein the collar and the tip are pivotably connected at a hinge.

Alternatively or additionally, in another example, a lower edge of an outer surface of the tip abuts the collar on a hinge side, and the lower edge of the outer surface of the tip is spaced apart from the collar on a side opposite the hinge side, defining a gap between the tip and the collar.

Alternatively or additionally, in another example, pivoting movement of the tip at the hinge moves the lower edge of the outer surface of the tip towards the collar on the side opposite the hinge, thereby actuating the pump assembly to deliver product from the container.

Alternatively or additionally, in another example, actuation of the pump assembly includes moving the pump assembly in a downward motion, compressing a spring disposed around the pump assembly.

Alternatively or additionally, in another example, pivoting movement is achieved by application of tilting force on the tip, wherein upon removal of the tilting force, the spring causes the tip to return to a rest position, stopping product delivery.

Alternatively or additionally, in another example, the tip is flexible.

Alternatively or additionally, in another example, the tip is silicone.

Alternatively or additionally, in another example, the tip includes one or more internal voids.

Alternatively or additionally, in another example, an upper portion of the tip is curved, and the outlet is disposed on a side surface of the tip defining a convex curve.

Alternatively or additionally, in another example, the pump assembly is an airless pump.

In another example, a device for dispensing a cosmetic product comprises a container configured to hold a volume of cosmetic product, and a cosmetic dispensing system coupled to an open upper end of the container. The cosmetic dispensing system comprises a pump assembly disposed within an open upper end of the container, a driver connected to the pump assembly, an actuator connected to the driver, and a tip connected to the actuator and having an outlet for dispensing cosmetic product, the tip defining a curved upper surface of the device, wherein the tip is configured to be tilted to deliver a portion of the volume of cosmetic product to the outlet, wherein the tip is pivotably connected to the actuator on a first side of the tip, and a bottom surface of the tip is separated from an upper surface of the actuator by a space on a second side of the tip, wherein the first and second sides are opposite each other, wherein the driver includes an elongated member extending into the space, wherein an upper end of the elongated member contacts the bottom surface of the tip, wherein manually tilting the tip moves the bottom surface of the tip through the space towards the upper surface of the actuator, the bottom surface of the tip applying a downward force on the elongated rod, which applies a downward force on the pump assembly, thereby activating the pump assembly, and expelling the portion of cosmetic product from the outlet.

In another example, a device for dispensing a cosmetic product comprises a container configured to hold a volume of cosmetic product, and a cosmetic dispensing system coupled to an open upper end of the container. The cosmetic dispensing system comprises a collar connected to the open upper end of the container, a pump assembly disposed within the collar, and a tip connected to the collar and pump assembly, the tip having an outlet for dispensing cosmetic product, the tip defining a curved upper surface of the device, the tip having a first side and a second side opposite the first side, wherein the tip is configured to be moved from a rest position to a tilted position relative to the container to actuate the pump assembly and deliver a portion of the volume of cosmetic product to the outlet, wherein the tip is pivotably connected to the collar on the first side of the tip, and a lower edge of the tip is spaced apart from an upper edge of the collar by a gap on the second side of the tip, wherein the pump assembly includes an upper portion extending across the gap when the tip is in the rest position, wherein manually tilting the tip moves the lower edge of the tip across the gap towards the upper edge of the collar, the tip applying a downward force on the upper portion of the pump assembly, thereby activating the pump assembly, and expelling a portion of cosmetic product from the outlet.

Alternatively or additionally, in another example, the outlet of the tip is on the second side of the tip, and the first side of the tip includes a curved surface for engagement with a finger of a user.

Alternatively or additionally, in another example, the device comprises a flexible connector having a first end and a second end and defining a product delivery passageway therebetween, the first end coupled to the pump assembly and the second end coupled to the tip, the flexible connector adapted to flex from a first configuration when the tip is in the rest position to a second configuration when the tip is in the tilted position.

Alternatively or additionally, in another example, the flexible connector defines an axis with the first end laterally offset from the second end relative to the axis of the flexible connector, such that the product delivery passageway remains open in both the first and second configurations.

BRIEF DESCRIPTION OF THE DRAWINGS

The foregoing and other aspects of the present disclosure are best understood from the following detailed description when read in connection with the accompanying drawings. In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure relates generally to a device which dispenses a cosmetic product. This technology is particularly well-suited for, but by no means limited to, liquid cosmetic products such as concealer, foundation, lotion, or serum.

Figure 1:
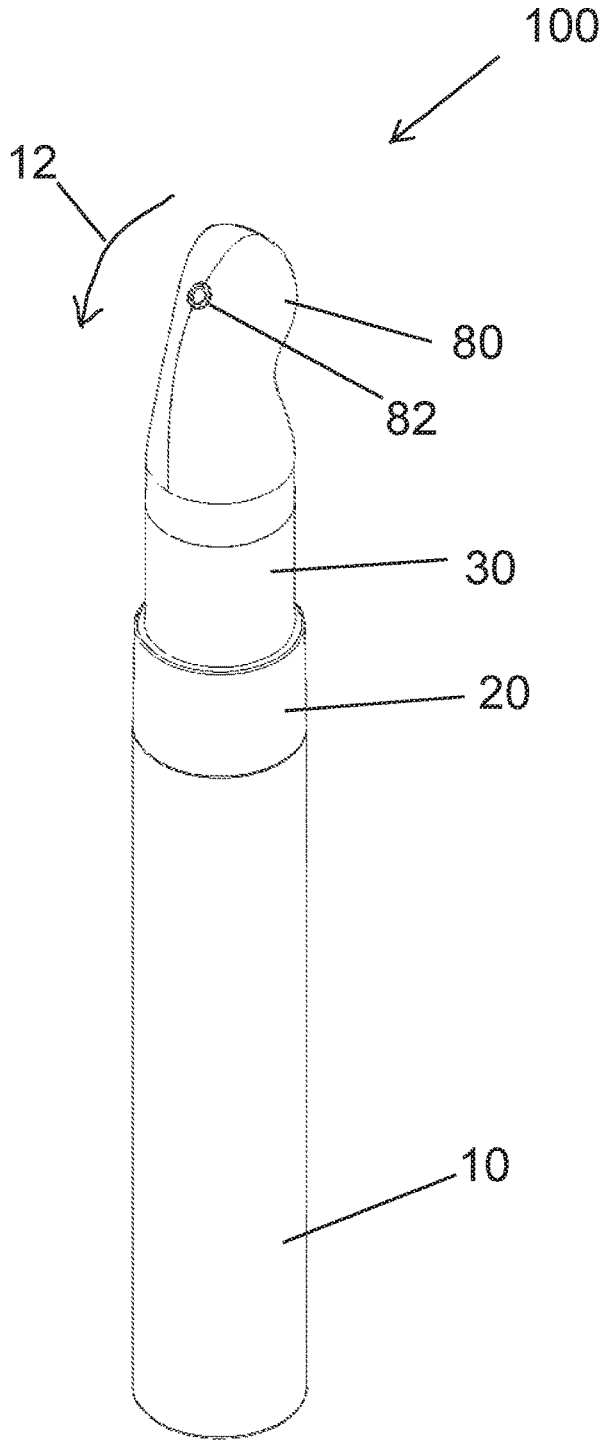
FIG. 1 is a perspective view of a device for dispensing a cosmetic product according to one example, with the cap removed.

FIG. 1 illustrates a device 100 for dispensing a cosmetic product such as a liquid. The device 100 as illustrated includes a bottle or container 10, a neck 20, a collar 30, and a flexible tip or sleeve 80 with an outlet 82 for dispensing the cosmetic product. The device 100 for dispensing a cosmetic product is shown in an elongated cylindrical configuration. However, it should be understood that examples of the disclosure described herein may be applied to various other configurations in other examples. For example, the device 100 may alternatively be embodied in an elongated square or polygonal configuration where the components of the device are all of such shapes. Other shapes include oval, triangular, heart shaped, etc. Alternatively, the flexible tip or sleeve 80 may comprise a sponge, brush, or other cosmetic applicator in place of, covering, or surrounding the outlet 82.

Figure 2:
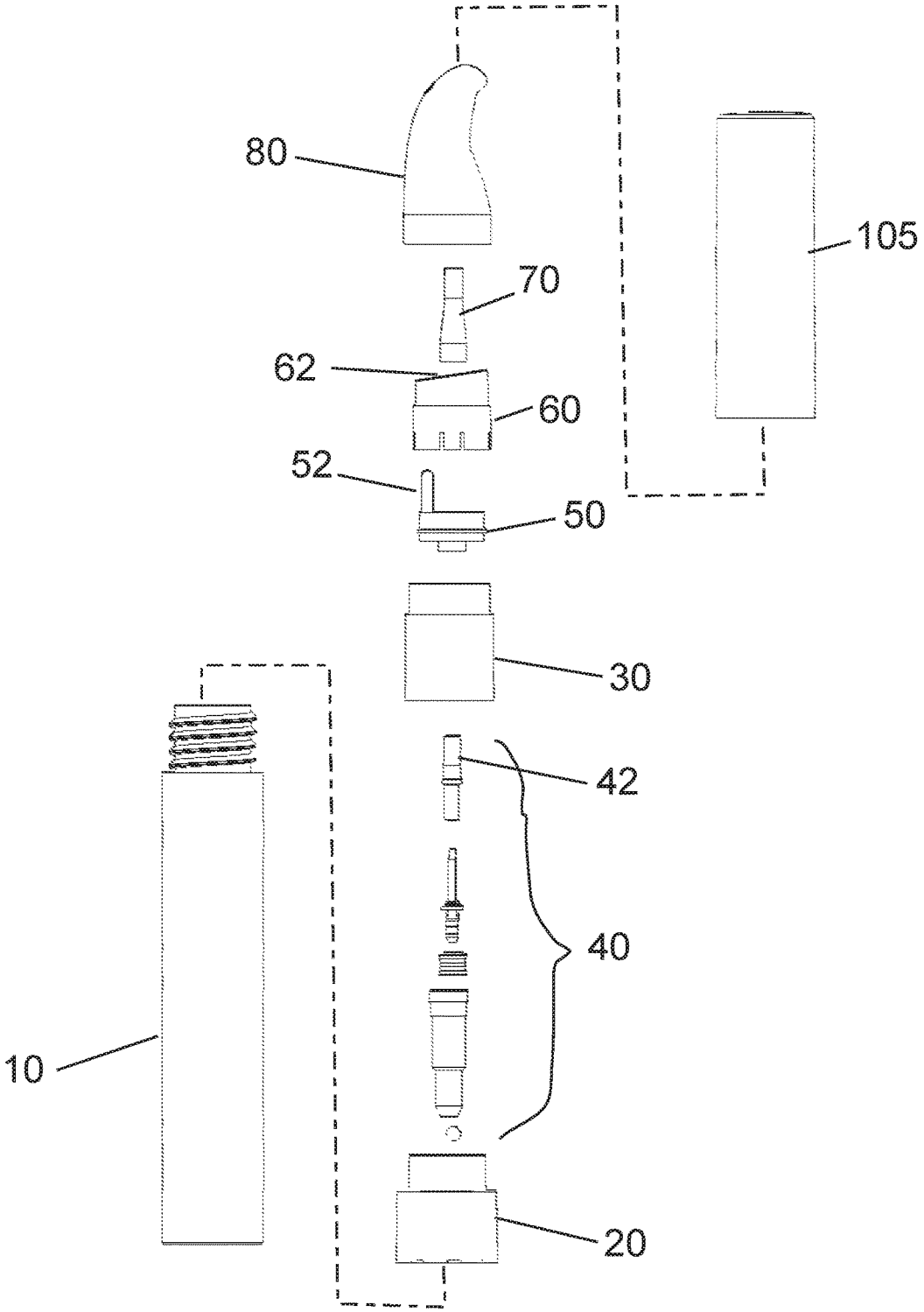
FIG. 2 is a side exploded view of the device of FIG. 1 including the cap.

The device 100 is configured such that tilting or bending the upper portion of the flexible sleeve 80 in the direction of arrow 12 activates a pump mechanism to dispense the cosmetic product. The container 10 is configured to hold a volume of the cosmetic product to be dispensed. In some examples, the container 10 may include an inner reservoir (not shown). The container 10 may be a rigid bottle, made of glass or hard plastic. In other examples, the container 10 may be made of a flexible material. As seen in FIG. 2, the device 100 includes a cap 105 configured to be disposed over the sleeve 80 and engage the neck 20. The cap 105 may have a friction fit, snap fit, threaded engagement, or other suitable connection to the neck 20.

Figure 3:
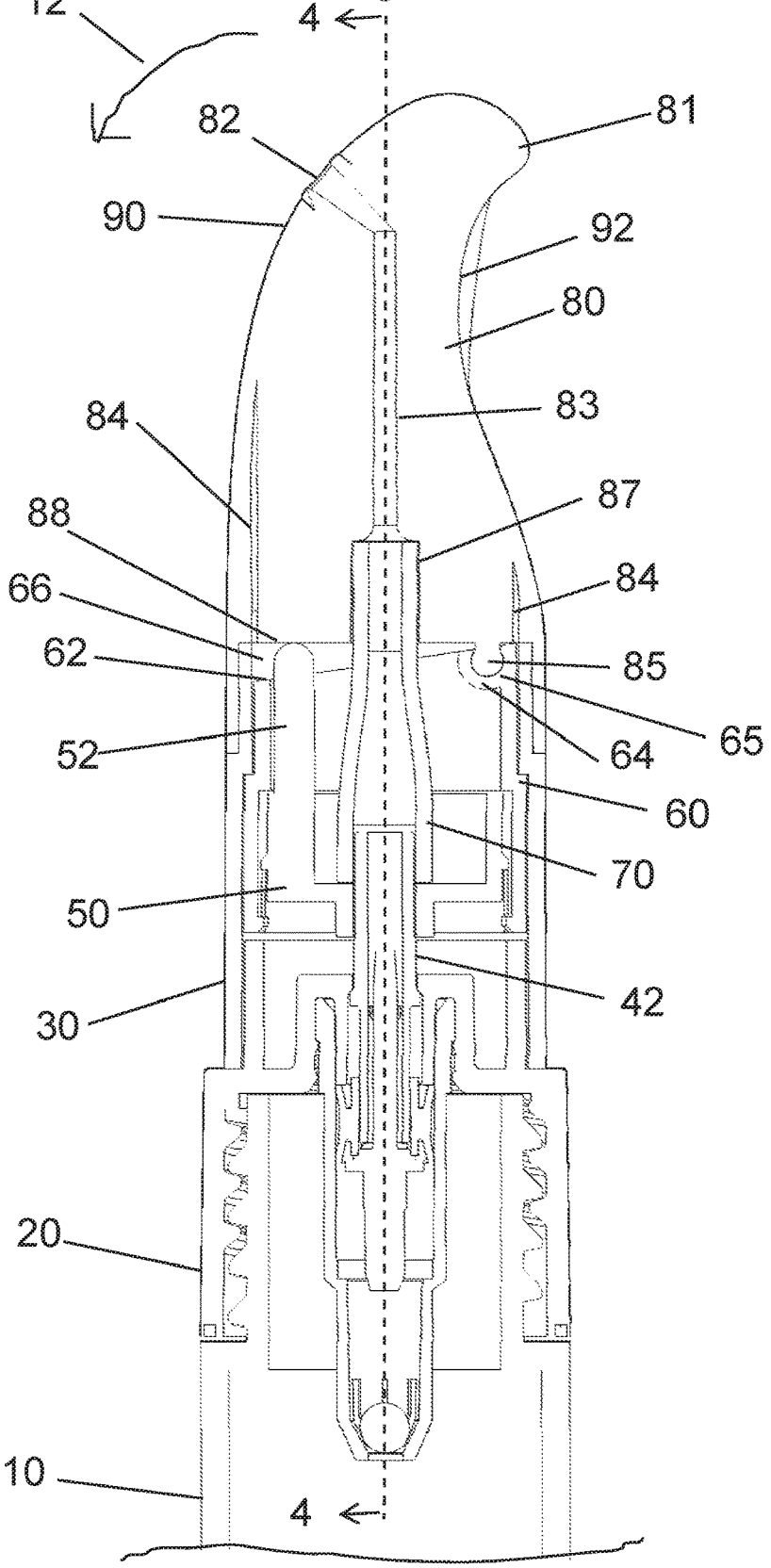
FIG. 3 is a partial side cross-sectional view of the device of FIG. 1.

The device 100 includes an actuating mechanism that moves the liquid product from the container 10 to the outlet 82. The actuating mechanism may be a pump assembly 40. In some examples, the pump assembly 40 may be an airless pump. The pump assembly 40 may be contained within the upper portion of the container 10, the neck 20, and the collar 30, as shown in FIG. 3. The neck 20 may have a threaded engagement with the upper end of the container 10, allowing the container 10 to be refilled. In other examples, the neck 20 may be fixed to the top of the container 10. The neck 20 and collar 30 may have internal structure that hold the parts of the pump assembly 40 in position within the device 100. A driver 50, actuator 60, and connector 70 are also disposed within the collar and, in combination with the sleeve 80, provide a tilting actuation mechanism. The driver 50 is disposed within the collar 30 and the lower portion of the driver 50 is connected to an upper member 42 of the pump assembly 40. The lower end of the connector 70 is disposed over the upper end of the upper member 42 of the pump assembly. The connector 70 extends through the driver 50 and actuator 60, and extends into the sleeve 80. An upper end of the connector 70 is disposed within a chamber 87 in the sleeve 80.

The tilting movement of the sleeve 80 is provided by the structure of the sleeve 80 and its orientation relative to the actuator 60. In some examples, the sleeve 80 is made of a flexible material such as silicone. In other examples, the sleeve 80 may be made of metal such as zinc aluminum alloys like ZAMAC, including any alloys with a base metal of zinc and alloying elements of aluminum, magnesium, and copper. In still other examples, the sleeve 80 may be made of ceramic or plastic. A sleeve 80 made of plastic may be flocked, particularly on the convex surface 90.

As seen in FIG. 3, the sleeve 80 has a bent tip 81 configured to provide a surface on which the user may apply force with a finger, bending the sleeve 80 in the direction of arrow 12. The sleeve 80 has a convex surface 90 and an opposing concave surface 92 that help define the bent tip 81. The convex surface 90 may be used as an application surface. The sleeve 80 may have one or more vertical cut outs or slots 84 extending upwards from a bottom inner surface 88 of the sleeve 80, allowing for a greater range of motion of the tip 81 in the direction of arrow 12. In the example shown in FIG. 3, two slots 84 are shown, however additional slots are contemplated.

Figure 4:
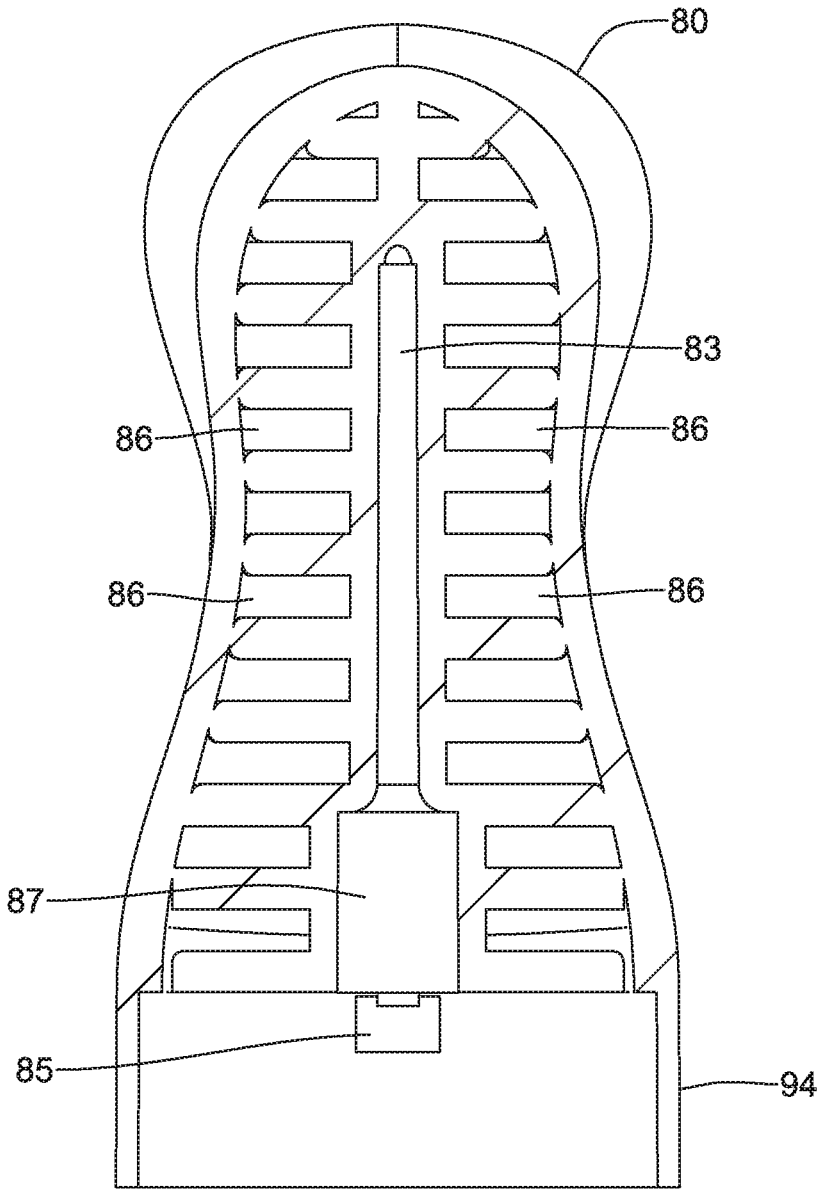
FIG. 4 is a partial cross-sectional view taken along lines 4-4 of FIG. 3.

Additionally, as seen in FIG. 4, which is a cross section of just the sleeve 80 taken along line 4-4 of FIG. 3, the sleeve 80 may have a series of internal cut outs or voids 86, reducing the volume of material in the sleeve 80 and increasing the flexibility of the sleeve 80. The voids 86 may collapse as the sleeve is bent and the slots 84 may become compressed as the sleeve is bent in the direction of arrow 12. Upon removing the force acting on the bent tip 81, the sleeve 80 returns to the rest position, shown in FIG. 3. The structure of the sleeve 80 is sufficiently rigid to return to the rest position after the voids 86 and slots 84 have been collapsed. The pattern, shape, and number of voids 86 illustrated in FIG. 4 are exemplary, and other numbers, shapes, and patterns of voids 86 may be provided within the sleeve 80. The sleeve 80 may include a passageway 83 connecting the outlet 82 with the upper portion of the connector 70. The passageway 83 is sized and configured such that it remains open when the bent tip 81 of the sleeve 80 is tilted in the direction of arrow 12. The passageway 83 may be defined entirely by the sleeve 80. In other examples, the passageway 83 may include a separate elongated tube member disposed within the sleeve 80.

Figure 5:
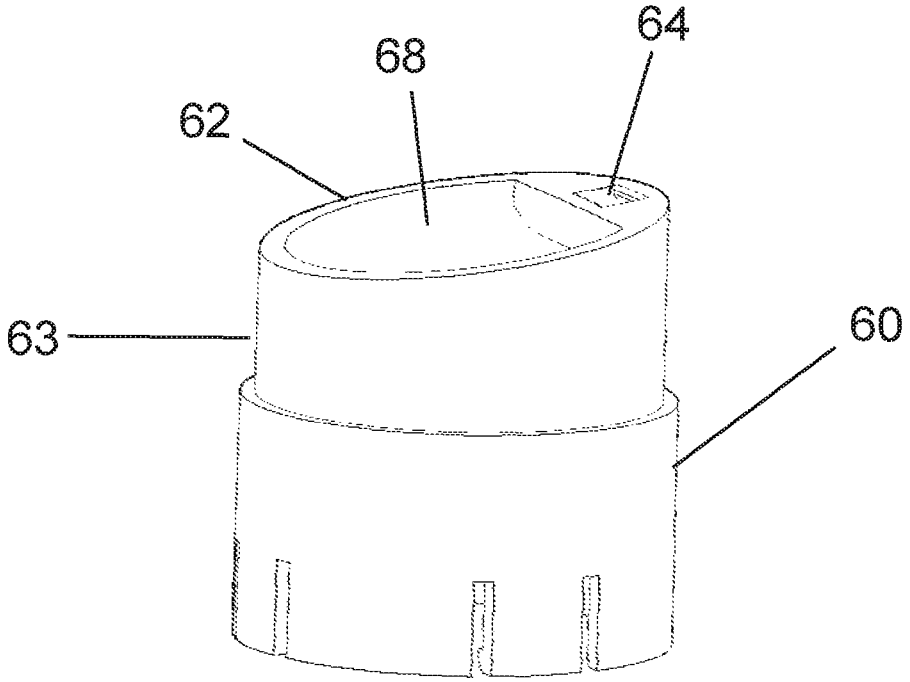
FIG. 5 is a perspective view of the actuator of the device of FIG. 1.

The sleeve may include a protrusion 85 extending from the upper surface of the actuator 60. The protrusion 85 rotates within the cavity 64, defining a pivot 65 around which the sleeve 80 rotates relative to the actuator 60. The pivot 65 may be the only connection between the sleeve 80 and the actuator 60. In other examples, the lower end of the sleeve 80 may include an extension 94 that fits over the upper portion 63 of the actuator 60 in a sliding engagement. The actuator 60 includes an angled upper face 62, as shown in FIG. 5. In a resting position, shown in FIG. 3, the bottom inner surface 88 of the sleeve 80 is generally horizontal (perpendicular to the longitudinal axis of the device 100) and there is a space 66 between the bottom inner surface 88 and the angled upper face 62 of the actuator on the side of the device opposite the pivot 65. In other examples, the bottom inner surface 88 of the sleeve may be at an angle greater or less than 90 degrees from the longitudinal axis of the device 100. Changing the angle of the bottom inner surface 88 of the sleeve increases or decreases the volume of the space 66, and changes the range of motion of the sleeve 80 relative to the actuator 60.

The sleeve 80 is biased in the resting position shown in FIG. 3 by the force of a rod 52 extending vertically from the driver 50. The driver 50 is disposed within the actuator 60 with the rod 52 extending upwards through the central opening 68 of the actuator 60. The driver 50 and rod 52 are made of a rigid material. Movement of the sleeve 80 in the direction of arrow 12 causes the bottom inner surface 88 of the sleeve to move through space 66 towards the angled upper face 62 of the actuator 60, thereby pushing the rod 52 of the driver 50 downward, which in turn applies a downward force on the upper member 42 of the pump assembly 40, actuating the pump assembly 40 to expel product from the container 10 through the pump assembly 40, the connector 70, the passageway 83, and out the outlet 82. When the sleeve 80 is released, the rigid rod 52 moves back into its resting position, pushing the bottom inner surface 88 of the sleeve 80 upward into the resting position shown in FIG. 3. Continuous pressure on the bent tip 81 by the user, in the direction of arrow 12, may be needed to expel a continuous stream of product.

Figure 6:
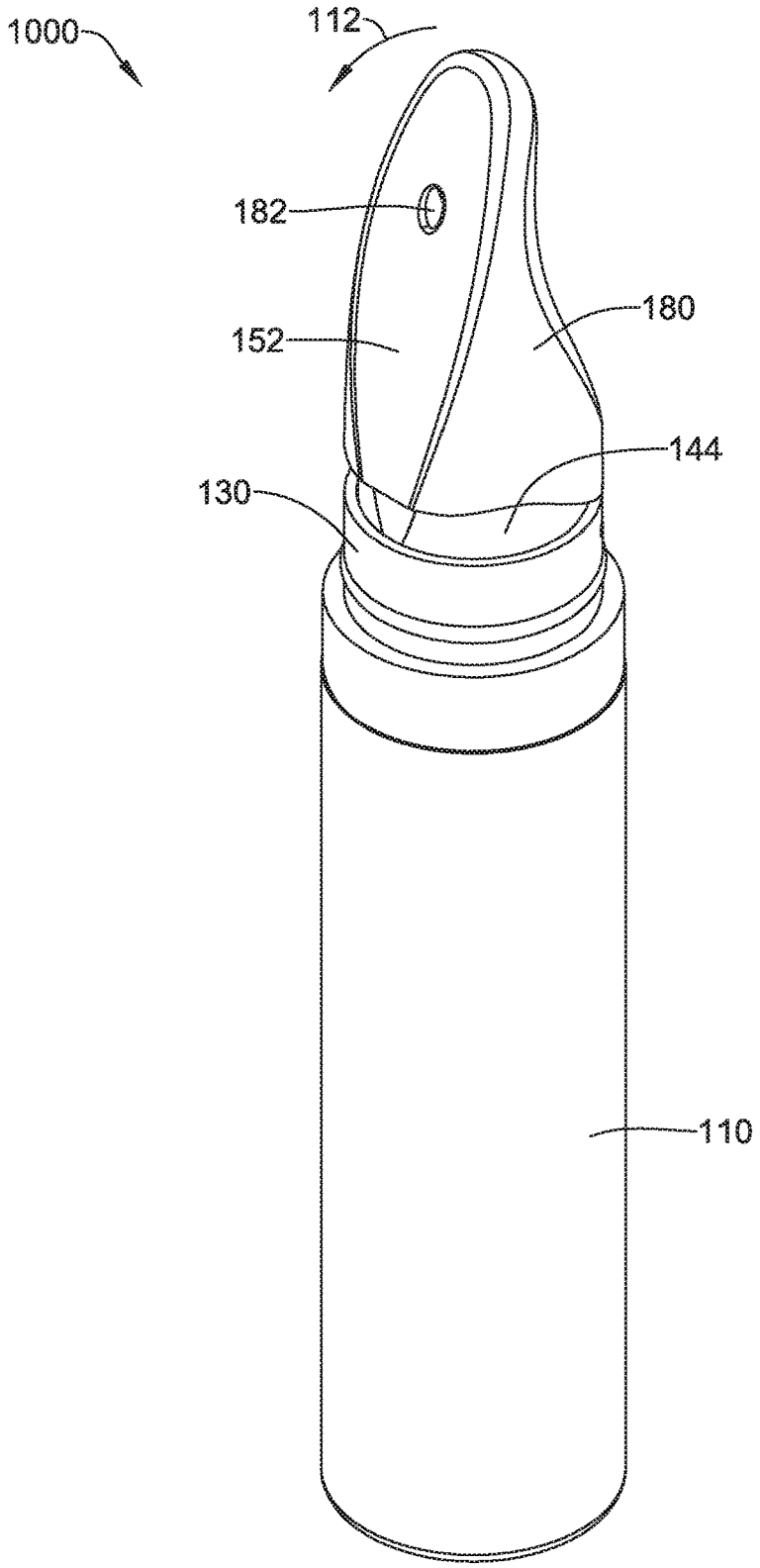
FIG. 6 is a perspective view of another device for dispensing a cosmetic product according to another example, with the cap removed.

FIG. 6 illustrates another device 1000 for dispensing a cosmetic product such as a liquid. The device 1000 as illustrated includes a bottle or container 110, a collar 130, and a tip 180 with an outlet 182 for dispensing the cosmetic product. The device 1000 for dispensing a cosmetic product is shown in an elongated cylindrical configuration. However, it should be understood that examples of the disclosure described herein may be applied to various other configurations in other examples. For example, the device 1000 may alternatively be embodied in an elongated cubical configuration where the components of the device are all cubical in shape. Other shapes include oval, triangular, heart shaped, etc. Alternatively, the tip 180 may be a sponge, brush, or other cosmetic applicator.

Figure 7:
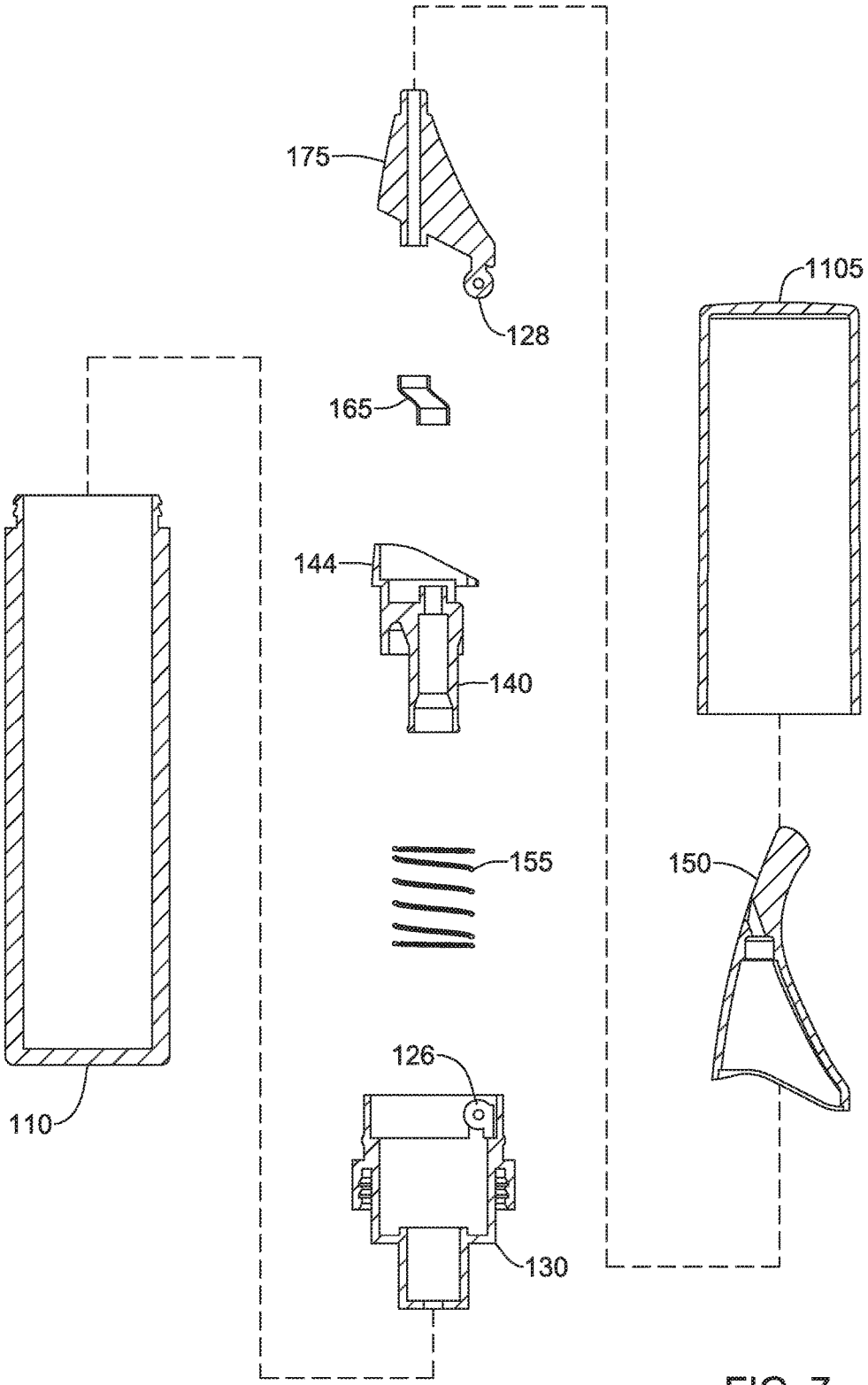
FIG. 7 is a side cross-sectional exploded view of the device of FIG. 6.

The device 1000 is configured such that tilting the tip 180 in the direction of arrow 112 activates a pump mechanism to dispense the cosmetic product. The container 110 is configured to hold a volume of the cosmetic product to be dispensed. In some examples, the container 110 may include an inner reservoir (not shown). The container 110 may be a rigid bottle, made of glass or hard plastic. In other examples, the container 110 may be made of a flexible material. As seen in FIG. 7, the device includes a cap 1105 configured to be disposed over the tip 180 and engage the collar 130. The cap 1105 may have a friction fit, snap fit, threaded engagement, or other suitable connection to the collar 130.

Figure 8A:
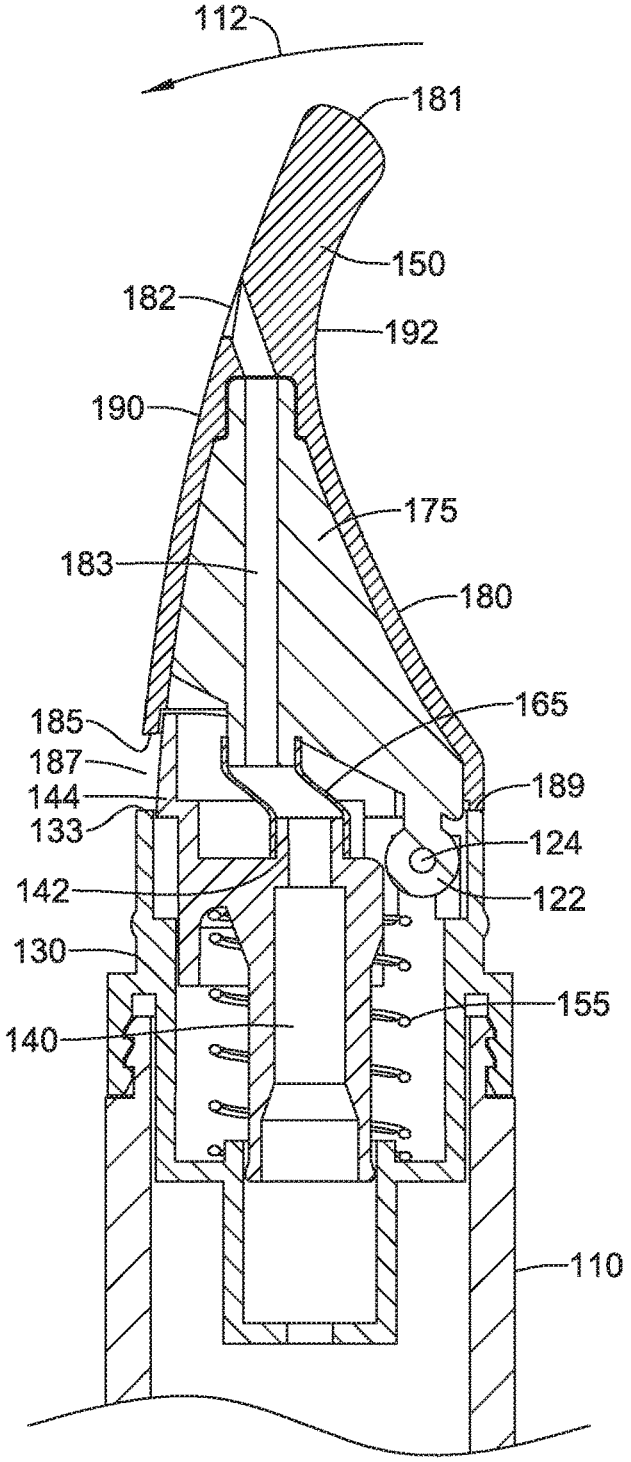
FIG. 8A is a partial side cross-sectional view of the device of FIG. 6, with the tip in a rest position.

The device 1000 includes an actuating mechanism that moves the liquid product from the container 110 to the outlet 182. The actuating mechanism may be a pump assembly 140. Any type of pump mechanism may be used. The pump mechanism may be configured to be used in only the upright orientation or both upright and upside down orientations. In some examples, the pump assembly 140 may be an airless pump. The pump assembly 140 may be contained within the upper portion of the container 110 and the collar 130, as shown in FIG. 8A. The collar 130 may have a threaded engagement with the upper end of the container 110, allowing the container 110 to be refilled. The collar 130 may have internal structure that hold the parts of the pump assembly 140 in position within the device 1000. In some examples the tip 180 may include a sleeve 150 disposed over an inner tip 175. The sleeve 150 may include an application surface 152 surrounding the outlet 182. The application surface 152 may be used to apply the product directly onto the user's skin. In other examples, the tip 180 may be a single element including the structure of the inner tip 175. A flexible connector 165 is also disposed within the sleeve 150 and, in combination with the sleeve 150 and collar 130, provides a tilting actuation mechanism.

Figure 8B:
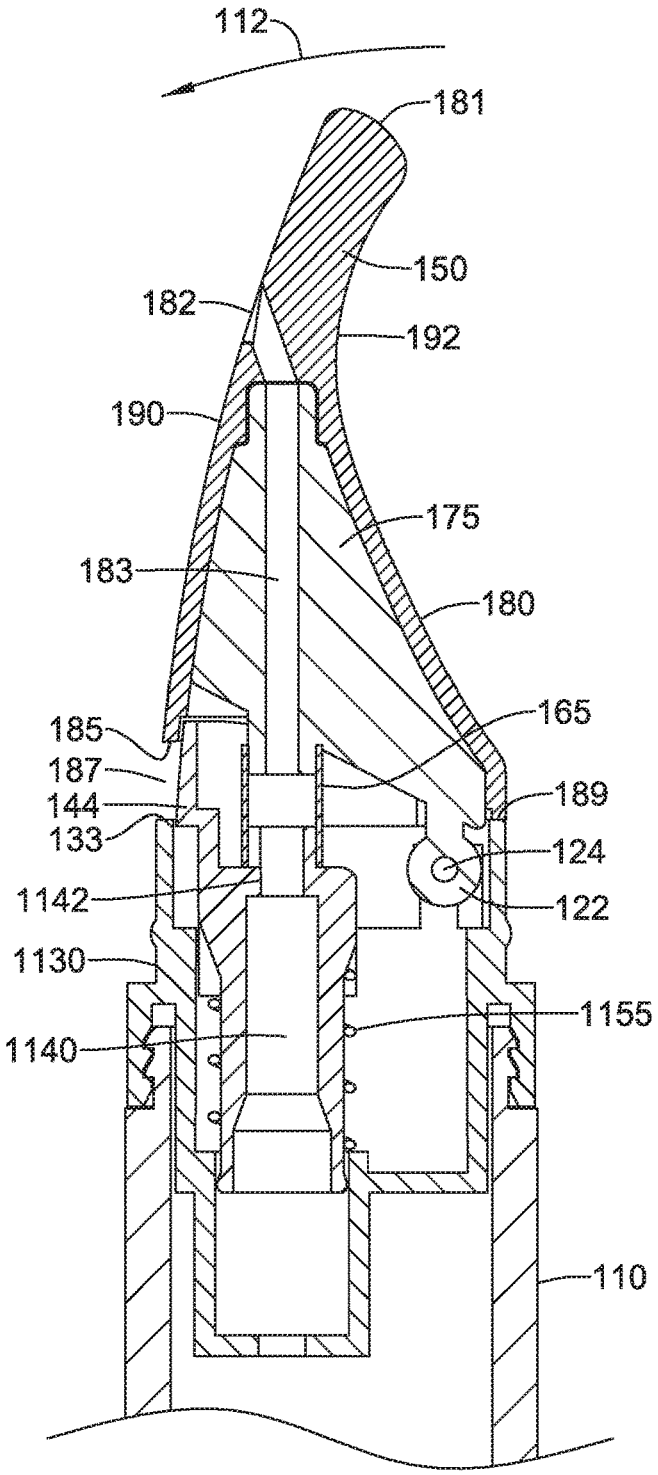
FIG. 8B is a partial side cross-sectional view of a device according to another example, with the tip in the rest position.

In the example illustrated in FIG. 8A, the passageway in the upper member 142 of the pump assembly 140 is laterally offset from the passageway 183 in the inner tip 175. In the example illustrated in FIG. 8B, the pump assembly 1140 is offset and the passageway through the upper member 1142 is aligned with the passageway 183 in the inner tip 175. The collar 1130 and spring 1155 are structured to provide the pump assembly 1140 in alignment with the passageway 183. The flexible connector 165 defines a produce delivery passageway and connects the passageway through upper member 142, 1142 to passageway 183.

The flexible connector 165 is adapted to flex from a first configuration when the tip 180 is in the rest position to a second configuration when the tip 180 is in the tilted position. In the example illustrated in FIG. 8A, the flexible connector 165 defines an axis with a first end laterally offset from a second end relative to the axis of the flexible connector 165, such that the product delivery passageway remains open in both the first and second configurations, avoiding pinching or crimping of the flexible connector 165. In the example illustrated in FIG. 8B, the flexible connector 165 defines an axis aligned with both the passageway 183 and the upper member 1142, and provides the flexibility needed to keep the delivery passageway open when the tip is actuated.

The sleeve 150 is fixed to the inner tip 175. A spring 155 is disposed around the pump assembly 140 within the collar 130. The spring 155 biases the tip 180 and the pump assembly 140 in the upright or extended position shown in FIG. 8A. The lower portion of the flexible connector 165 is connected to an upper member 142 of the pump assembly 140. The upper portion of the flexible connector 165 is connected to a lower portion of a passageway 183 connecting the outlet 182 with the pump assembly 140. The passageway 183 is sized and configured such that it remains open when the tip 180 is tilted in the direction of arrow 112. The passageway 183 may be defined entirely by the sleeve 150 and inner tip 175. In other examples, the passageway 183 may include one or more separate elongated tube members disposed within the sleeve 150 and inner tip 175.

Figure 9:
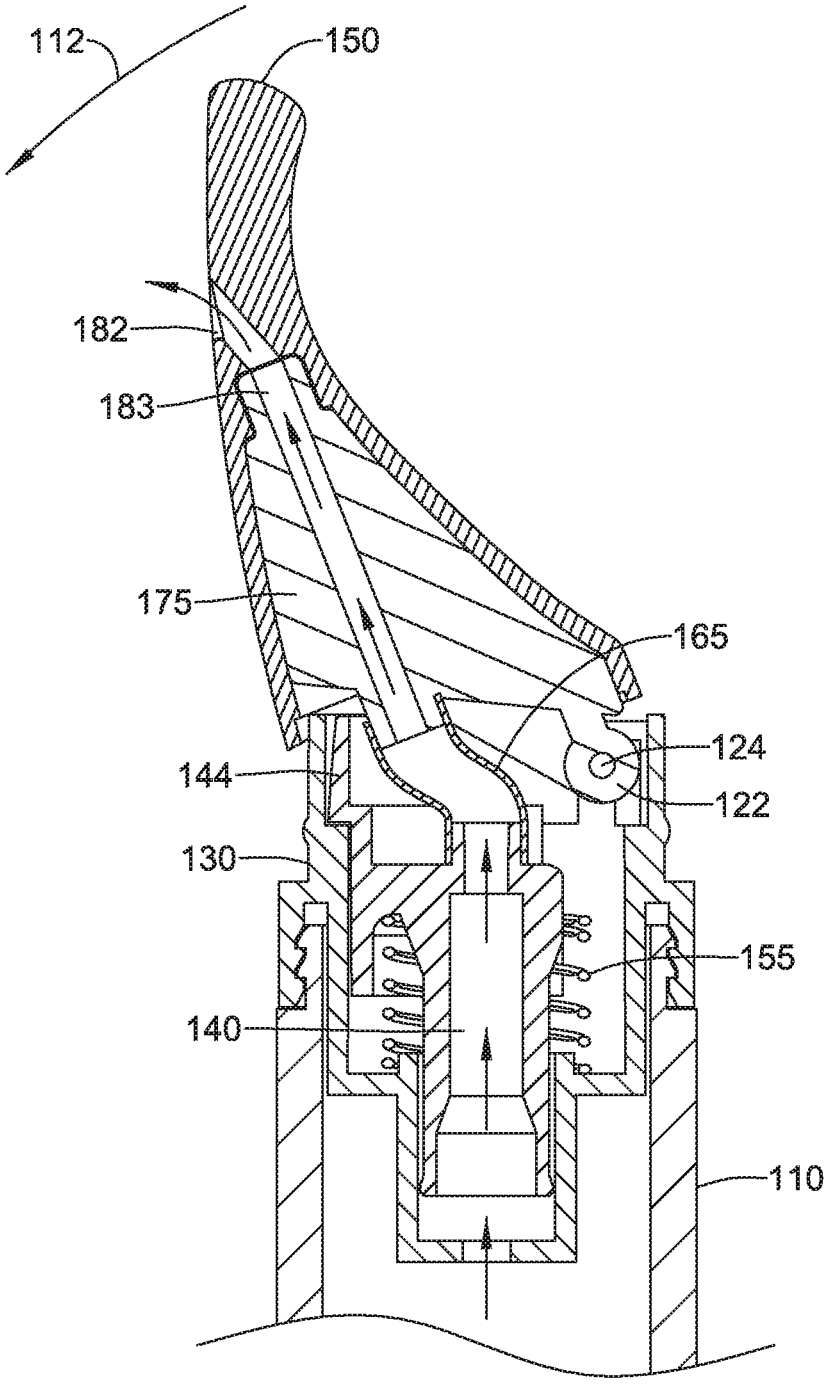
FIG. 9 is a partial side cross-sectional view of the device of FIG. 6, with the tip in a tilted position.

The tilting movement of the tip 180 is provided by a hinge 122. The hinge 122 may include a first hinge portion 126 defined by the collar 130 and a second hinge portion 128 defined by the inner tip 175, with the first and second hinge portions 126, 128 rotating relative to each other to define a pivot point 124. The hinge 122 may be the only connection between the tip 180 and the collar 130. When in the extended or rest position as shown in FIG. 8A, the lower edge 185 of the tip 180 on the side opposite the hinge 122 is spaced apart longitudinally by a gap 187 from the upper edge 133 of the collar 130. An upper portion 144 of the pump assembly 140 is visible in the gap 187 between the upper edge 133 of the collar 130 and the lower edge 185 of the tip 180, as seen in FIGS. 1 and 3. On the hinge side the tip 180 abuts the collar 130 at junction 189. The hinge 122 and gap 187 provide a rotation of the tip 180 relative to the container 110 of between about 10 degrees to about 40 degrees. In some examples, the rotation is between about 20 and 30 degrees. In other examples, the rotation is between about 25 and 28 degrees. When the tip 180 is rotated or tilted in the direction of arrow 112, the lower edge 185 of the tip 180 may meet or abut the upper edge 133 of the collar 130. In some examples, the lower edge 185 of the tip 180 may slide past the upper edge 133 of the collar 130 and move along the outer surface of the collar 130, as shown in FIG. 9. When the tip 180 is tilted forward, the upper portion 144 of the pump assembly 140 is pushed down inside the collar 130 as the pump is depressed, as shown in FIG. 9. Tilting the tip 180 forward pushes the pump assembly 140 downward, as indicated by arrow 114, compressing the spring 155 and causing product to flow out through the pump assembly 140, flexible connector 165, passageway 183 and out the outlet 182. Continuous pressure on the bent tip 181 by the user, in the direction of arrow 112, may be needed to expel a continuous stream of product.

In some examples, the sleeve 150 is made of a flexible material such as silicone. In other examples, the sleeve 150 may be of metal including zinc aluminum alloys such as ZAMAC, ceramic, stone, glass, or plastics such as thermoplastic elastomers (TPE), polypropylene (PP), polyethylene (PE). The sleeve 150 may have an application surface 152 that includes flocking. In other examples, the sleeve 150 may include a sponge or a brush as the application surface 152 (not shown). In some examples, the entire sleeve 150 or just the application surface 152 may be made of a material that transfers and/or stores thermal energy, such as metal, ceramic, stone, glass, volcanic materials, and composites thereof.

As seen in FIG. 8A, the sleeve 150 has a bent tip 181 configured to provide a surface on which the user may apply force with a finger, bending the tip 180 in the direction of arrow 112. The sleeve 150 has a convex curved surface 190 and an opposing concave curved surface 192 that help define the bent tip 181. The outlet 182 may be disposed on the convex curved surface 190. Upon removing the force acting on the bent tip 181, the tip 180 returns to the rest position due to the action of the spring 155, shown in FIG. 8A. In other examples, the sleeve 150 may be made of a rigid material such as a metal or hard plastic.

Thus, for example, in use the user of either of the devices shown above may hold the container 10, 110 in the palm of the hand at a diagonal from approximately the index finger diagonally across the palm to the heel of hand opposite the thumb, and may actuate the tip 80, 180 by pressing with the index finger. Alternatively the user may hold the container 10, 110, axially with the fingers wrapped around the container 10, 100 and actuate the tip 80, 180 by pressing with the thumb. Either way, a controlled amount of product is reliably dispensed through the actuation onto a desired surface, such as the skin of the user, without having to use the hand or an intermediate product such as a sponge to perform the application, as is more common with standard pump mechanisms. While most dispensers provide an actuation mechanism requiring axial movement from the dispenser end of the device, or from the opposite end from the dispenser, the present product facilitates a lateral action for the pump actuator and translates the lateral action into axial movement for purposes of obtaining the pump motion. As used herein, such lateral actuation may be termed tilting.

Each of the above non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A device for dispensing a cosmetic product, the device comprising:

a container configured to hold a volume of cosmetic product; and a cosmetic dispensing system coupled to an open upper end of the container and comprising:

a collar connected to the open upper end of the container;

a pump assembly disposed within the collar; and a tip connected to the collar and pump assembly, the tip having an outlet for dispensing cosmetic product, the tip defining a curved upper surface of the device, the tip having a first side and a second side opposite the first side;

wherein the tip is configured to be moved from a rest position to a tilted position relative to the container to actuate the pump assembly and deliver a portion of the volume of cosmetic product to the outlet, wherein the tip is pivotably connected to the collar on the first side of the tip, and a lower edge of the tip is spaced apart from an upper edge of the collar by a gap on the second side of the tip;

wherein the pump assembly includes an upper portion extending across the gap when the tip is in the rest position;

wherein manually tilting the tip moves the lower edge of the tip across the gap towards the upper edge of the collar, the tip applying a downward force on the upper portion of the pump assembly, thereby activating the pump assembly, and expelling a portion of cosmetic product from the outlet;

wherein the outlet of the tip is on the second side of the tip, and the first side of the tip includes a curved surface for engagement with a finger of a user;

wherein the device further comprises a flexible connector having a first end and a second end and defining a product delivery passageway therebetween, the first end coupled to the pump assembly and the second end coupled to the tip, the flexible connector adapted to flex from a first configuration when the tip is in the rest position to a second configuration when the tip is in the tilted position.

2. The device of claim 1 wherein the flexible connector defines an axis with the first end laterally offset from the second end relative to the axis of the flexible connector, such that the product delivery passageway remains open in both the first and second configurations.

* * * * *